United States Patent [19]

Speare et al.

[11] Patent Number: 5,000,211

[45] Date of Patent: Mar. 19, 1991

[54] TENT STRUCTURE

[75] Inventors: Roger L. Speare, Bolton; William I. Liddell, Bath, both of England

[73] Assignee: Aquila Shelters Limited, Bolton, United Kingdom

[21] Appl. No.: 381,673

[22] PCT Filed: Jan. 15, 1988

[86] PCT No.: PCT/GB88/00025

§ 371 Date: Jul. 17, 1989

§ 102(e) Date: Jul. 17, 1989

[87] PCT Pub. No.: WO88/05489

PCT Pub. Date: Jul. 28, 1988

[30] Foreign Application Priority Data

Jan. 16, 1987 [GB] United Kingdom ..... 8700911

[51] Int. Cl.[5] ..... E04H 15/18

[52] U.S. Cl. ..... 135/97; 135/100; 135/114; 52/14; 52/16

[58] Field of Search ..... 135/102, 98, 99, 117, 135/112, 97, 99, 100; 52/14–16, 235

[56] References Cited

U.S. PATENT DOCUMENTS

| | | | |
|---|---|---|---|
| 2,677,384 | 5/1954 | Luisada | 135/102 |
| 2,928,403 | 3/1960 | Hoskins | 135/98 X |
| 3,810,481 | 5/1974 | Nohmura | 135/101 |
| 4,558,713 | 12/1985 | Hagler et al. | 135/106 |
| 4,801,137 | 1/1989 | Bolt | 52/16 X |

FOREIGN PATENT DOCUMENTS

| | | | |
|---|---|---|---|
| 0241887 | 10/1987 | European Pat. Off. | 135/87 |
| 1148044 | 5/1963 | Fed. Rep. of Germany | 135/120 |
| 0277064 | 10/1964 | Netherlands | 135/106 |
| 26083 | of 1899 | United Kingdom | 135/114 |
| 2123870 | 2/1984 | United Kingdom | 135/106 |

*Primary Examiner*—David A. Scherbel
*Assistant Examiner*—Lan Mai
*Attorney, Agent, or Firm*—Nixon & Vanderhye

[57] ABSTRACT

A modular tent structure comprises a canopy structure (20) including a peripheral frame (23) adapted to support a covering roof sheet (24) and comprising collapsible sides, each constituted by a central crown joint structure to each side of which is pivoted a laterally extending support member (34), and a tie member releasably interconnecting the crown joint structure and the pivotally-connected laterally-extending support members (34). An axially-extendible mast structure is disposed centrally of the peripheral frame and is adjustable to vary tension in the covering roof sheet (24). Bracing means releasably interconnect the central mast structure and each central crown joint of the peripheral frame (23). The canopy structure (20) is adapted to be supported above ground by corner pillars (21), each pillar (21) having on two adjacent faces connecting or haunch plates to which canopy structure (20) is detachably connected, and the pillars (21) having open vertical housings or formations for receiving side wall retention elements.

37 Claims, 6 Drawing Sheets

TENT STRUCTURE

This invention relates to tent structures and especially but not exclusively to modular tent structures which can be used, inter alia, by fighting and emergency services for personnel accommodation and disaster relief reception area and accommodation but which also finds use in exhibition accommodation and social accommodation such as, for example, weddings or fetes.

US-A-215 1908 discloses a collapsible tent structure having a canopy structure comprising a peripheral frame having collapsible sides, two opposed of which are each constituted by a central crown joint structure to each side of which is pivoted a laterally-extending support member with a tie member releasably interconnecting the crown joint structure and each of the pivotally connected laterally-extending support members.

The peripheral frame supports a covering roof sheet which is also supported within the peripheral frame by a framework of a ridge pole and cross bow members.

It is an object of the present invention to provide a collapsible tent structure employing a peripheral frame with collapsible sides as disclosed in US-A-2151908 but which provides a tension-applying central support for the covering roof sheet supported by the peripheral frame.

It is another object of the present invention to provide a modular tent structure which is relatively lightweight for transport and erection and collapse purposes, which is of rigid robust construction when erected, and which is of a construction which permits two or more tent modules to be simply and quickly coupled together to provide an increased covered and sheltered area.

According to one aspect of the present invention there is provided a modular tent structure comprising a canopy structure including a peripheral frame adapted to support a covering roof sheet and comprising a collapsible side constituted by a central crown joint structure to each side of which is pivoted a laterally-extending support member, and a tie member releasably interconnecting the crown joint structure and the pivotally-connected laterally-extending support members, the modular tent structure being characterised in that each collapsible side of the peripheral frame is so constituted by a central crown joint structure, support members and tie members, and in that there is provided an axially- extendible mast structure disposed centrally of the peripheral frame and adjustable to vary tension in the covering roof sheet, and bracing means releasably interconnecting the central mast structure and each central crown joint structure of the peripheral frame.

According to another aspect of the present invention there is provided a modular tent structure comprising a canopy structure comprising a central mast structure for elevating and tensioning a covering roof sheet at its centre relative to a peripheral frame to which the covering roof sheet is connected, the central mast structure comprising a relatively axially movable mast and surrounding sleeve adapted to be detachably secured in an axially-extended position, and adjustment means for moving the mast relative to the surrounding sleeve while in the axially-extended position to increase or decrease the tension in the covering roof sheet.

According to still another aspect of the present invention there is provided a modular tent structure comprising a canopy structure adapted to be supported above ground by corner pillars, each pillar having on two adjacent faces connecting or haunch plates to which the canopy structure can be detachably connected, and the pillars having open vertical housings or formations for receiving side wall retention elements.

Preferably, a bracing member detachably interconnects the central mast structure and each central crown joint structure of each side of the peripheral frame.

Preferably, the adjacent ends of the support members of adjacent peripheral frame sides are flexibly tied together.

Preferably, the central mast structure and each central crown joint structure is interconnected by flexible supports, preferably webbing belts, disposed under the covering roof sheet to assist in supporting same.

Preferably, flexible elements, for example high tensile cables, interconnect the outboard ends (ends adjacent the sides of the peripheral frame) of the bracing members detachably connected to adjacent peripheral frame sides.

Preferably, tensioned flexible elements (e.g. cables) interconnect the bracing means detachably connected to adjacent peripheral frame sides (e.g. central crown joints).

According to yet another aspect of the present invention there is provided a tent arrangement comprising, in interconnected relationship, a plurality of tent modules as defined in some or all of the immediately preceding eight paragraphs.

An embodiment of the present invention will now be described by way of example with reference to the accompanying drawings in which:

FIGS. 12 to 12B are respectively fragmentary side views of an internal storm cable arrangement, the upper portion thereof, and a means of securing a tent wall to a vertical pillar.

Figures 1, 1A, 1B, 1C, 1D, 2, 7, 8:
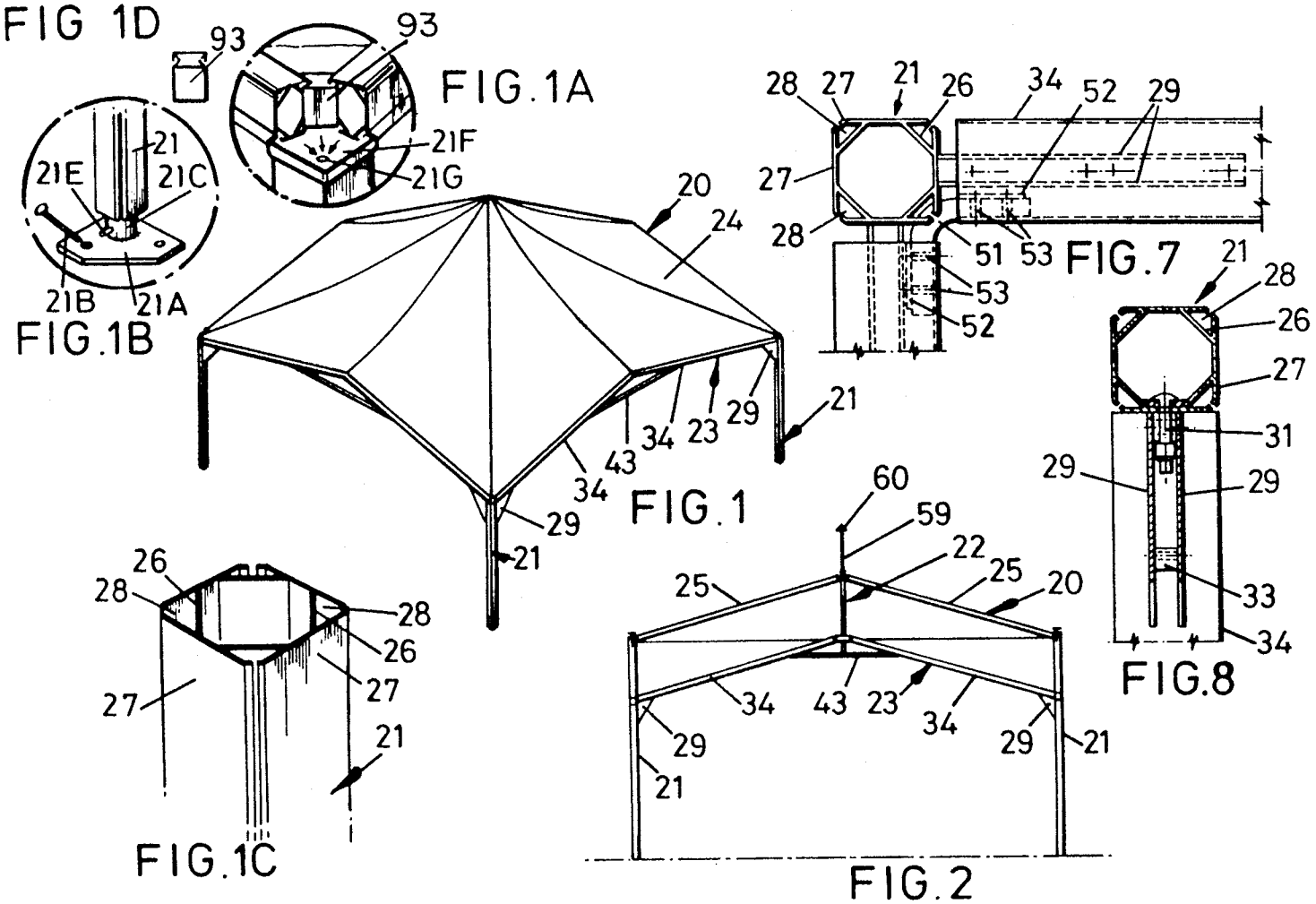
FIGS. 1 to 3 are respectively a perspective view, a side view and a plan view of a modular tent structure according to the present invention.
FIGS. 1A, 1B and 1C are respectively perspective detail views of the top, bottom and cross-section of a vertical pillar of the modular tent structure.
FIG. 1D is a perspective detail view of a positioning member of the type shown in FIG. 1A.
FIGS. 6 to 8 are respectively a side elevation, a plan view and a sectional elevation of a corner of the modular tent structure, FIG. 6A showing a modification.
Figure 3:
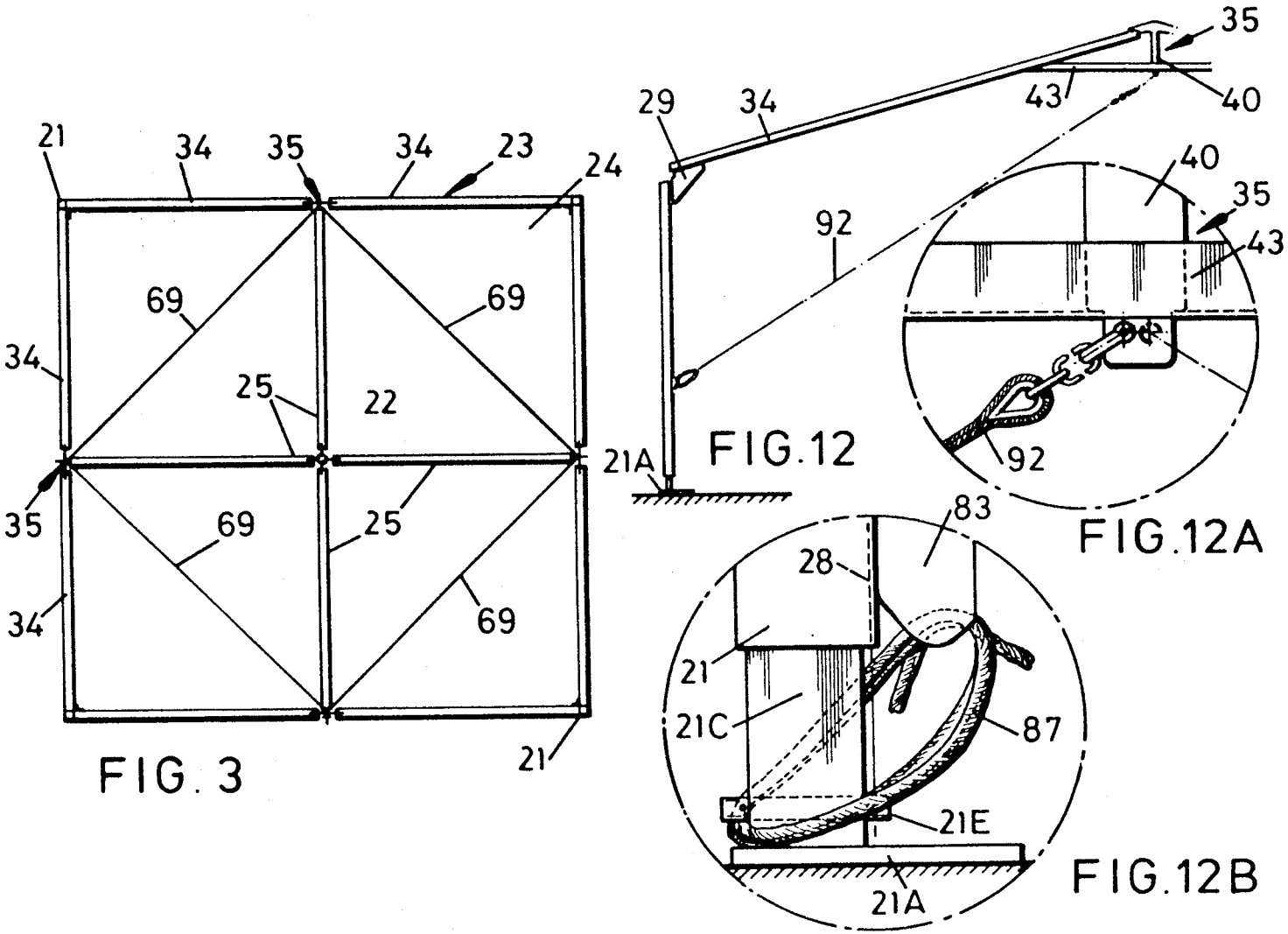

In general terms the modular tent structure comprises a canopy structure 20 supported by four corner pillars 21 and having a central mast structure 22 serving to provide the canopy structure 20 with downwardly sloping or inclined elevations from the centre of the canopy structure 20.

The canopy structure 20 includes a foldable collapsible peripheral frame 23 to each corner of which is detachably connected one of the corner pillars 21, and a covering sheet 24 of fabric, plastics material or any other convenient form of material defining the roof of the modular tent structure. The covering roof sheet 24 is connected to the peripheral frame 23 and the central mast structure 22.

The covering roof sheet 24 has an overhanging flap (not shown) which depends vertically at each side of the modular tent structure to provide a peripheral cowl for weatherproof purposes.

Bracing members 25 are pivotally or hingedly interconnected with the central mast structure 22 and detachably connected to the peripheral frame 23.

A detailed description of the structural components of the modular tent structure will now be described with reference to FIGS. 4 to 12B.

Firstly it should be noted that the major structural components of the modular tent structure are formed of aluminium extrusions which provide a strong robust but lightweight assembly.

Each corner pillar 21 (see especially FIG. 1C) comprises a central hollow octagonal configuration 26 having four integral peripheral webs 27 defining a square open at the corners to define along the length of each corner of the pillar 21 a triangular housing 28 open to the exterior of the pillar 21 and which may be employed for connecting to the pillar 21, a side wall of the modular tent structure, a pillar of an adjacent modular tent structure, other vertical structure such, for example, as a vertical fabric or plastics sheet defining a privacy shield, or a guying system for the modular tent structure.

The corner pillar 21 is height adjustable (see FIG. 11) having a foot 21A securable to the ground or other supporting surface by bolts, spikes or similar 21B, the foot 21A mounting an upstanding locating rod 21C formed with vertically-spaced holes 21D. The rod 21C is inserted into a pillar 21, whereof the webs 27 are apertured and provided with locating bushes as indicated at 27A to permit alignment of the bushed apertures 27A with selected holes 21D so that the rod 21C and pillar 21 can be detachably secured together by a pin 27B held in place by a clip 27C in known manner.

The locating rod 21C is formed with a fixed bottom cross-pin 21E for a purpose to be described later.

Any other convenient form of pillar height adjustment may be employed.

Figures 11, 11A:
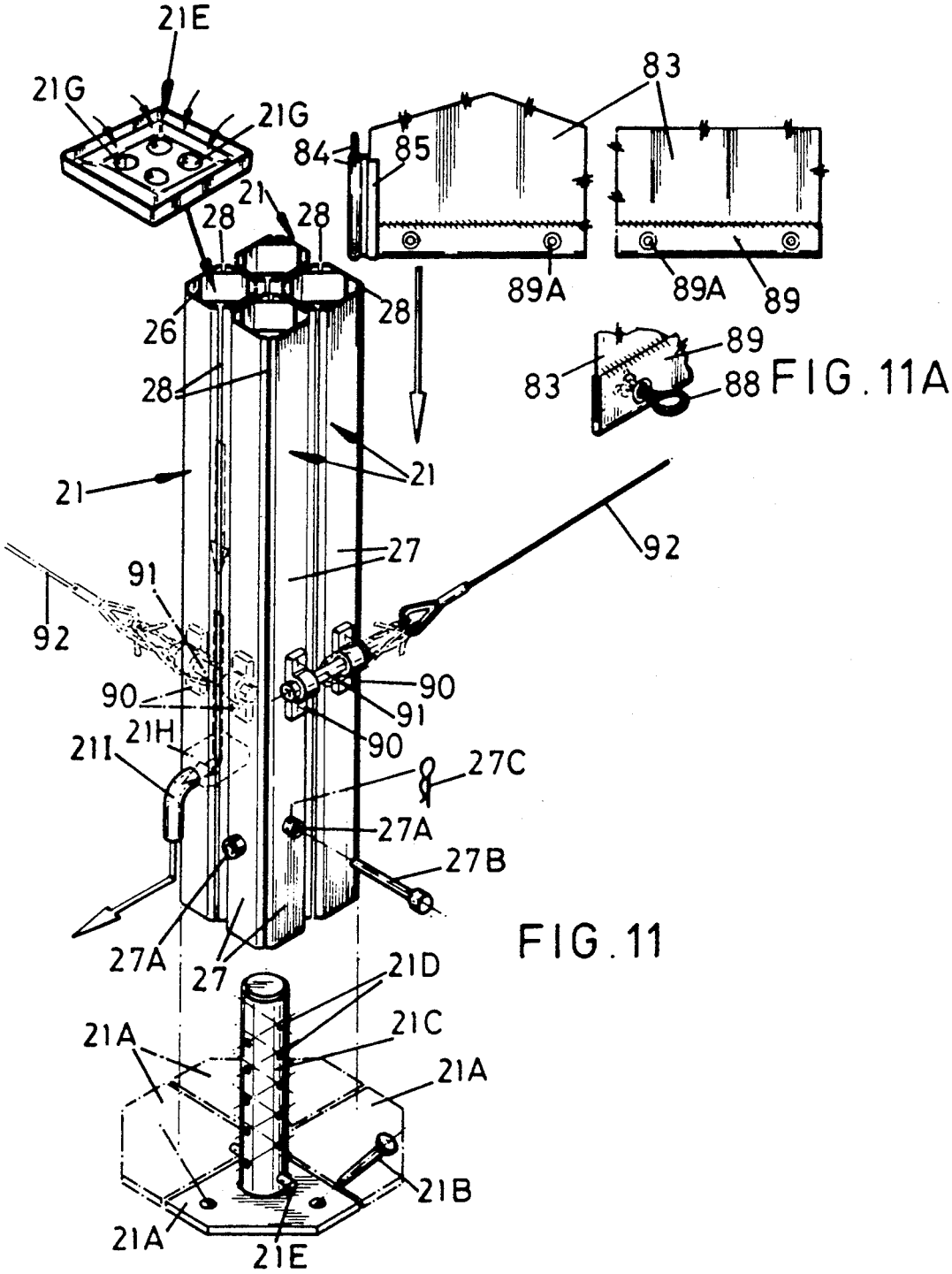
FIG. 11 is an exploded perspective view of an assembly of vertical pillars and a junction of four modular tent structures.
FIG. 11A is a partial perspective detail of a cord fastener attached to a fabric side wall of the tent structure.

The feet 21A are conveniently shaped as shown in FIG. 11 to be assembled in a group of two, three or four as required.

The upper end of a pillar 21, or group thereof, is closed by a plastics tray 21F formed with a hole or holes 21G for drainage purposes. Rainwater flows via a drainage hole 21G into the hollow corner pillar 21 which is blanked off internally by a plate at 21H, an outlet 21I just above the blanking plate 21H permits the rainwater or other liquid to be piped to a convenient location.

To each of two adjacent sides of each pillar 21 is secured a pair of parallel substantially triangular connection or haunch plates 29 which are connected to the adjacent face of the corner pillar 21 by connection plates 30. The latter are bolted to the face of the pillar 21 as indicated at 31 and extend between the parallel haunch plates 29 to which they are bolted as indicated at 32. The parallel haunch plates 29 are rigidly interconnected by hollow spacers 33 rivetted through the haunch plates 29.

The peripheral frame 23 is connected to the corner pillars 21 through the intermediary of the haunch plates 29 as will be later described.

The peripheral frame 23 is four sided and each side is identical and one of which will now be described.

Each side of the peripheral frame 23 comprises a pair of square sectioned hollow extrusions defining support members 34 which when the modular tent structure is erected are inclined upwardly from the corner pillars 21 to a central crown joint structure 35.

At its upper end i.e. its end adjacent the crown joint structure 35, the wall of each support member 34 receives solid hinge bar 36 which is slotted as indicated at 37 to engage the upper wall. The bar 36 is bolted to the upper wall as indicated at 38, and is of forked construction as indicated at 36A for pivotal connection to the crown joint structure 35 as indicated at 39.

The central crown joint structure 35 comprises a T-shaped member 40 with a top plate 41 disposed substantially in a plane at right angles to the plane containing the T-shaped member 40.

Figures 4, 4A, 5, 6, 6A:
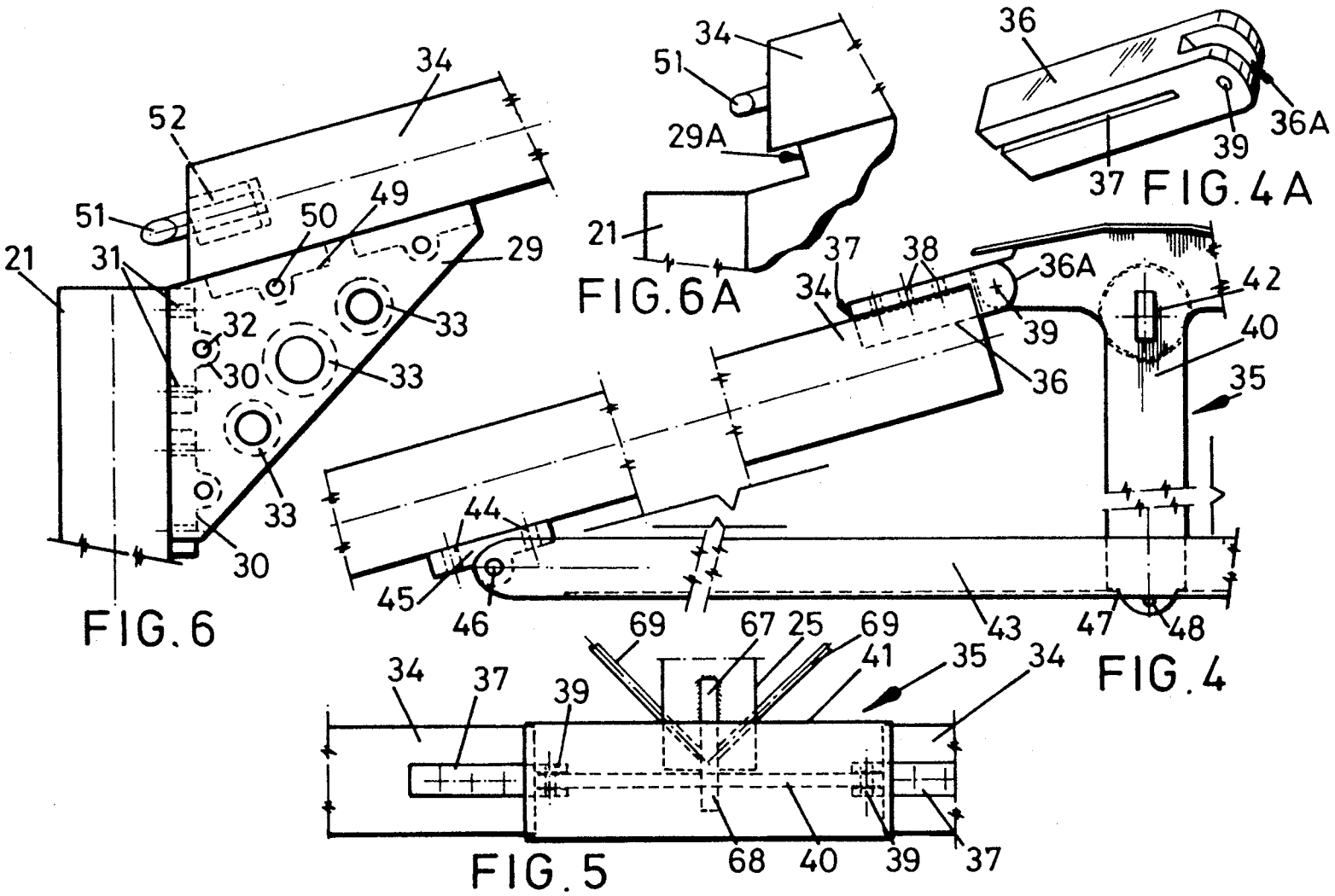
FIGS. 4 and 5 are respectively a fragmentary side elevation and a fragmentary plan view of the peripheral frame of the modular tent structure, FIG. 4A being a perspective view of a detail thereof.

The pivotal connections 39 between the hinge plates 37 and the crown joint structure 35 are at the ends of the crown bar of the T-shaped member 40 as can be seen from FIGS. 4 and 5.

A slot 42 is formed in the T-shaped member 40 at the junction of the stem and cross bar for a purpose which will be hereinafter described.

The members 34 and crown joint structure 35 are interconnected by a tie member 43 of upwardly opened channel configuration.

Each support member 34 has bolted, as indicated at 44, to its under side a connection plate 45 similar to connection plate 30 and the adjacent end of the tie member 43 is pivotally connected to the connection plate 45 as indicated at 46. One pivotal connection 46 is permanent while the other is releasable.

The web of the channel member 43 is slotted at 47 and the bottom end of the T-shaped member 40 extends through the slot 47 and is formed with a hole which receives a retention pin 48 detachably to interconnect the T-shaped member 40 and the tie member 43.

At the ends of each support member 34 there are provided connection plates 49 identical to connection plates 30, which plates 49 extend between the haunch plates 29 to permit the support members 34 and consequently the sides of the peripheral frame 23 to be bolted as indicated at 50 to the haunch plates 29 connected to the vertical pillars 21.

In a preferred construction (see FIG. 6A), each haunch plate 29 is stepped as indicated at 29A, the lower end of the respective support member 34 overhanging the step 29A.

The sides of the peripheral frame 23 are tied together by a nylon braided rope 51 connecting the lower adjacent ends of the support members 34 of adjacent sides. The braided connecting ropes 51 are secured to their respective support members 34 by clamp plates 52 bolted to a side wall of each respective support member 34.

It is to be understood that, when an erected modular tent structure is to be collapsed for storage and/or transport purposes, the corner pillars 21 together with the attached haunch plates 29 will be detached from the peripheral frame 23 by releasing the bolts 50.

Figures 9, 10:
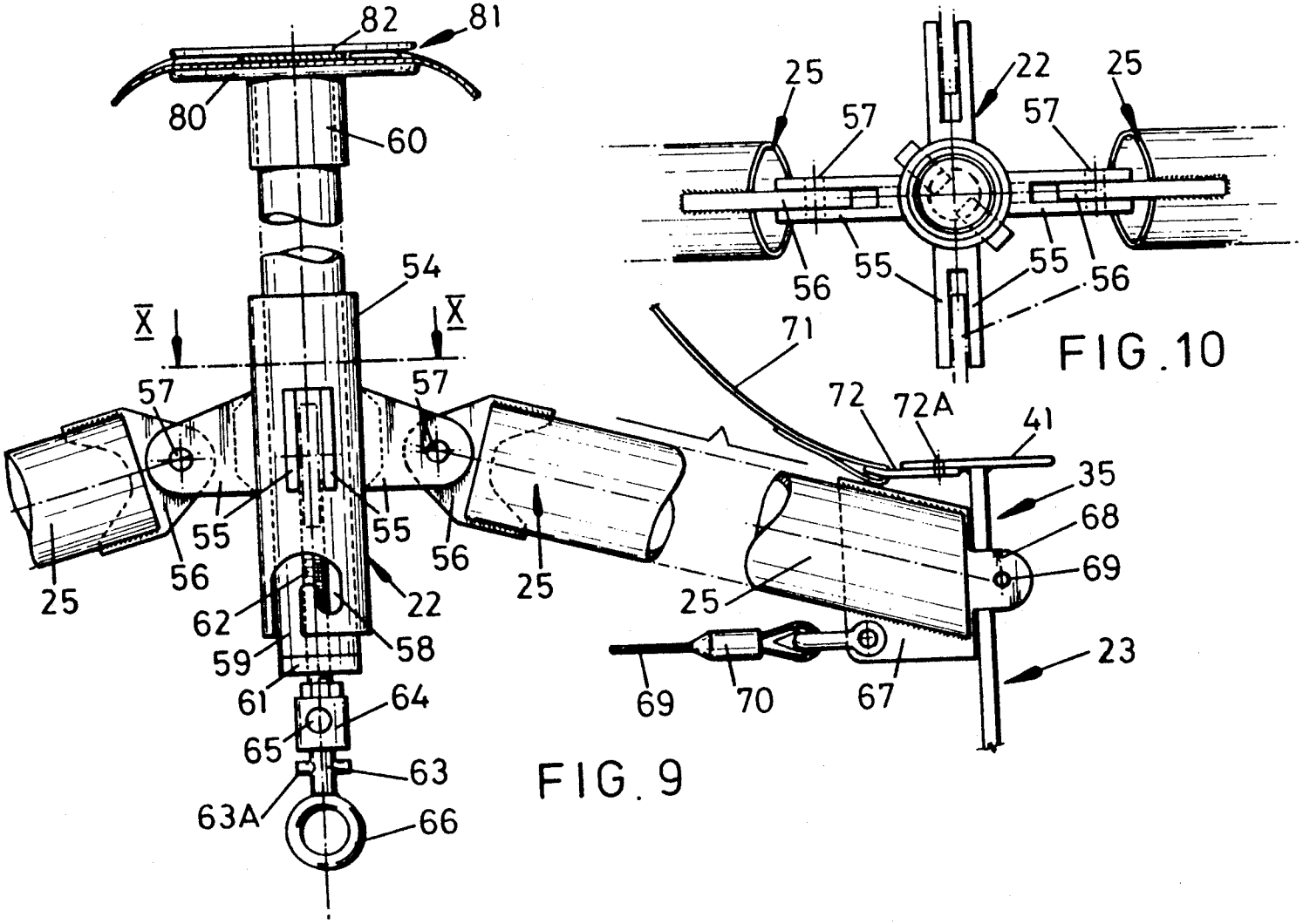
FIGS. 9 and 10 are respectively a side elevation, and a sectional plan view on the line X—X of the central mast structure of the modular tent structure, FIG. 9 showing the connections between the central mast structure and the peripheral frame of the modular tent structure.

Reference is now made to the central mast structure (see FIGS. 9 and 10). The central mast structure 22 comprises an outer sleeve 54 to which, at diametrically opposed locations, are welded pairs of parallel plates 55 between which are received plates 56 welded to the adjacent ends of tubular bracing members 25. Each plate 56 is pivotally connected between a respective pair of plates 55 as indicated at 57 so that the bracing members 25 are pivotally connected to the outer sleeve 54 at the inner ends of the bracing members 25. The outer sleeve 54 is formed at its lower end with two diametrically opposed, mirror image, bayonet slots 58, and inside the outer sleeve 54 is a tubular mast 59 adapted removably to receive a short tube 60 to the upper end of which is welded a lower clamp plate 80 of a clamp structure 81. The lower end of the mast 59 is closed by a plate 61 through which extends a vertical screw-threaded spindle or bar 62. A lower end 63 of the screw-threaded bar 62 which is of non-screw-threaded configuration extends through a block 64 carrying cross pins or posts 65 which project from opposed sides of the block 64 at each end at right angles to the lower end 63 of the screw-threaded bar 62. A handling or jacking ring 66 is connected to the lower end 63 below the block 64.

The block 64 and the cross pin 65 are therefore secured on the lower end 63 of the screw-threaded bar 62 between the jacking ring 66 and a shoulder defined by the difference in the cross sectional areas of the screw-threaded bar 62 and its lower end 63. The block 64 and cross pin 65 and the lower end 63 of the screw-threaded bar 62 are relatively rotatable.

In use, therefore, the ends of the cross pin 65 are aligned with the open bottom ends of the mirror image bayonet slots 58 and the mast 59 is pushed upwardly relative to the outer sleeve 54, the cross pin 65 then being dropped into the lateral portions of the bayonet slots 58, as it is usual, axially to locate the block 64 and cross pin 65 and consequently the mast 59 relative to the outer sleeve 54.

In a preferred modification, the lower surface of the block 64 has two right-angled slots (not shown) cut in it, either being engageable with a keying pin 63A on the lower end 63 below the cross pin 65. By this means, the block 64 can be pushed up to engage the keying pin, the mast 59 raised relative to the sleeve 54, and the bayonet connection made using only one hand. Such one-handed operation is obviously desirable.

It will be manifest that the tube 60 and its clamp structure 81 contacts the under side of the covering roof sheet 24: and is preferably secured thereto. By rotating the screw-threaded bar 62 by means of the jacking ring 66, the mast 59 can be caused to be moved upwardly relative to the outer sleeve 54 thus raising the centre of the covering roof sheet 24 and applying tension thereto.

The outer end of each bracing member 25 has welded to it a plate 67 having an apertured lug 68. This apertured lug 68 projects through the slot 42 in the T-shaped member 40 of the crown joint structure 35 at the respective side of the peripheral frame 23 and a pin (not shown) extends through the aperture or hole 69 in the lug 68 to secure the lower end of each bracing member 25 detachably to the crown joint structure 35 of its respective side.

The plate 67 of each bracing member 25 extends below the latter at its lower end and the bracing members 25 of adjacent peripheral frame sides are connected together by high tensile cables 69 connected by shackles 70 to the respective plates 67 of the bracing members 25.

Two right-angled webbing belts 71 for supporting the covering roof sheet 24, when the modular tent structure is in erected position, extend between the top plates 41 of opposed crown joint structures 35. The webbing belts 71 are connected to the top plates 41 by buckles 72 bolted to the top plates 41 as indicated at 72A. At the mast structure 22 the centres of the webbing belts 71 are secured by the clamp structure 81. More specifically, they are held between the bottom clamp plate 80 and an upper clamp plate 82, the clamp plates 80 and 82 being bolted together (not shown).

When the modular tent structure is in the erected position as shown in FIG. 1 side walls of fabric, plastics material or other convenient material can be fitted and are secured by rigid elements at each end which are accommodated in the housings 28 of the corner pillars 21.

A side wall 83 is indicated in FIGS. 11 and 12B which is engaged in the appropriate housing 28 by a bead 84 extending the height of the wall 83 and secured, thereto by any convenient means as indicated at 85. The bottom of the side wall 83 is tethered to the pillar 21 by a cable or similar 87 which is hitched around the cross-pin 21E.

The side wall 83 is also tethered to the edge of a floor of any convenient construction (not shown) by elastic cord fasteners 88 (only one shown) or similar secured to a welded-on strip of material 89 having holes 89A through which the cord fasteners 88 are secured. The cord fasteners 88 are pegged or otherwise fastened to the ground.

When building up an assembly of modular tent structures adjacent pillars 21, which are fitted with securing brackets 90 fitted to webs 27, are fastened together by bolts 91 anchoring two adjacent brackets 90 and consequently two adjacent pillars 21 together. Adjacent support members 34 are also bolted together.

A storm cable arrangement is provided to resist of a peripheral frame 23.

These cables 92 are normally collected and stored at or adjacent the appropriate pillar 21 when not in use.

In the collapsed storage and/or transport condition of the modular tent structure the corner pillars 21 with attached haunch plates 29 are separated from the canopy structure 20, the bayonet connection between the mast 59 and the outer sleeve 54 is released so that there is relative axial movement therebetween, each bracing member 25 is disconnected from its respective crown joint structure 35 (by removal of the securing pin (not shown) from lug 68 and separation of lug 68 from the slot 42 in the crown joint structure 35) and the crown joint structures 35 are released from the tie bars 43 (by withdrawal of retention pins 48), the releasable end of each tie bar 43 being detached from its connection plate 45 (by withdrawal of the respective pivotal pin 46).

The mast structure 22 without tube 60 and the clamp structure 81, and the bracing members 25 and connected high tensile cables 69 constituting a tetrahedron structure are separated from the canopy constituted by side members 34, 35 and 43, the webbing straps 71, covering roof sheet 24, the tube 60 and the clamp structure 81 for storage and transport purposes. The structural components of the canopy as defined can be bundled together and wrapped around the covering roof sheet 24. In this collapsed condition, the modular tent structure sub-assemblies, namely corner pillars, tetrahedron structure and canopy, can be stored, for example, in a convenient bag enclosure, or simply strapped or otherwise tied in the folded collapsed position. namely corner pillars, tetrahedron structure and canopy, can be stored, for example, in a convenient bag enclosure, or simply strapped or otherwise tied in the folded collapsed position.

Figure 13B:
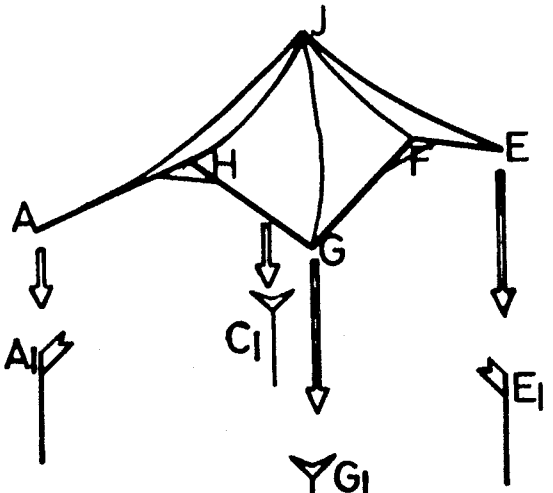
FIGS. 13 to 13C are diagrammatic views illustrating the various stages of erection of the modular tent structure.
Figure 13C:
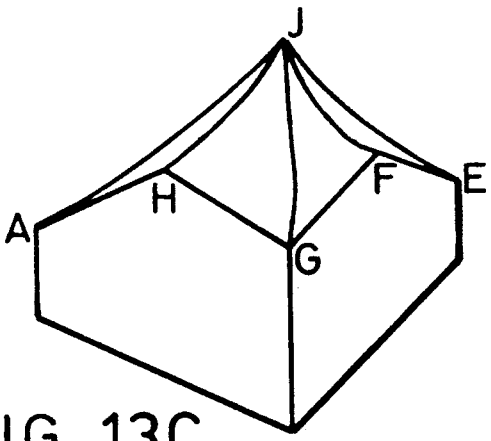
Figure 13A:
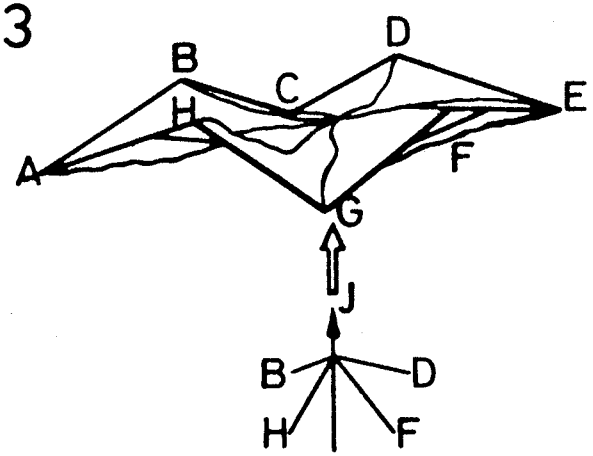
Figure 13:
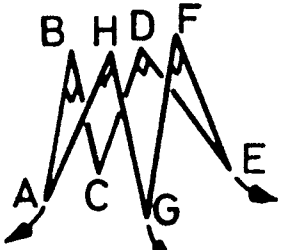

To erect the modular tent structure (FIGS. 13 to 13C), the tetrahedron structure is first laid out on the ground in the extended position, i.e. bracing members 25 radiating outwards from the mast structure 22. The canopy is then spread into open condition, i.e. the four corners of the peripheral frame 23 designated A, C, G, E in FIG. 13 are moved both peripherally outwards from the crown joint structures designated B, D, F, H and away from each other so that the four sides of the peripheral frame 23 are in extended position with the support members extending laterally away from the crown joint structures B, D, F, H (FIG. 11A). The opened canopy is laid on top of the opened tetrahedron structure, and each released end of each tie member is then connected once again to its respective support member, and each crown joint structure is connected to its respective tie bar as previously described. The tetrahedron structure is now connected via the bracing members to the crown joint structures.

At this stage therefore the peripheral frame is of rigid square construction with the central mast structure designated J still in collapsed position.

The central mast structure J is now axially adjusted to make the bayonet connection (bayonet slots 58, block 64 and a cross pin 65) which raises the covering roof sheet 24 at the centre. The mast 59 is then jacked upwardly by the screw-threaded bar 62 as previously described to tension the covering roof sheet 24 relative to the peripheral frame 23 as shown in FIG. 13B. Positioning members 93 with wedge-shaped recesses are fitted between the corners of adjacent sides of the peripheral frame 23 to locate and hold same in extended position.

When the canopy structure is in this condition the respective corner pillars A1, C1, E1, G1 are disposed at each corner and the lower ends of the support members 34 are connected to the respective haunch plates 29 by the connection plates 49 and bolts 50.

Side walls 83 can now be connected across the open sides of the erected modular tent structure (FIG. 13C) by appropriately engaging the retention members (85, 86) in the housings 28 of the corner pillars.

The side walls 83 can alternatively be fitted to the support members 34 before the corner pillar 21 is connected to the fully erect canopy structure.

It will be manifest that at least one of the side walls will have a door and, of course, if required one or more of the side walls may be provided with a transparent area to form a window. The side walls of course may be completely transparent and they may of course be of solid construction i.e. of wood or other convenient rigid material such as rigid plastics material. Any convenient form of flooring can be provided within the modular tent structure.

Two or more tent modules can be connected together to provide a larger covered area than a single tent module. This is effected by butting together the sides of two or more tent modules as hereinbefore described and bolting the adjacent corner pillars and support members together. Alternatively haunch plates 29 can be provided on three or four sides of the corner pillars 21 which would permit the connection of tent modules together with only one of the tent modules having four corner pillars while the others would have only one or two corner pillars at the side outboard from the tent module with the four corner pillars 21.

It will be manifest that to collapse a modular tent structure as hereinbefore described it is simply necessary to release and remove the corner pillars 21, to disconnect the bracing members from the crown joint structures 35 of the sides of the peripheral frame 23, and to release the bayonet connection of the central mast structure 22 and remove the tetrahedron structure. Each tie member 43 of the canopy is detached at one end from its support member 34 and is disconnected from the T-shaped member 40 of the crown joint structure 35. The structural components of the canopy are then folded within the covering roof sheet. The collapsed modular tent structure sub-assemblies can then be tied together by means of surrounding straps, or be bagged.

The material from which the side walls 83 is formed is cut on a bias, i.e. the fabric or other flexible material from which the side walls 83 are formed is cut at an angle to the warp direction, and this provides an extremely strong and flexibly rigid side wall.

We claim:

1. A canopy assembly for a tent structure, the canopy assembly comprising:

(A) a frame defining the periphery of the canopy and adapted to mount and support a covering roof sheet, said frame including a plurality of adjacent and interconnected collapsible side assemblies, each side assembly being defined by:

(i) a central crown joint structure;

(ii) a support member pivotally connected to and extending laterally from each of two opposed sides of the central crown joint structure; and (iii) a tie member releasably connecting the opposed support members and the central crown joint structure;

(B) an axially-extendable mast structure disposed centrally of the peripheral frame and adjustable to vary tension in the covering roof sheet when the latter is mounted and supported on the peripheral frame;

(C) a plurality of releasable bracing means, each having one end connected to the central mast structure and another end connected to a respective central crown joint structure; and (D) a tensioning means connecting the bracing means of each side assembly, at its central crown joint structure connecting end, to the central crown joint structure end of the bracing means of each adjacent side assembly, whereby the side assemblies are secured together at their centers in tension.

2. A canopy assembly as claimed in claim 1 in which each side assembly comprises the pair of support members pivotally connected at one end to a respective opposed side of the central crown joint structure, the tie member pivotally connected at opposed ends to a respective one of the support members, and a releasable connection between the central crown joint structure and the tie member.

3. A canopy assembly as claimed in claim 2 in which each central crown joint structure comprises a depending member adapted to extend through a slot defined by the respective tie member, a retention pin being provided releasably to engage the depending member below the tie member detachably to secure the central crown joint structure and the tie member together.

4. A canopy assembly as claimed in claim 3 in which each central crown joint structure is a T-shaped member defining a crossbar and a depending stem, the support members being pivotally connected to respective ends of the crossbar and the stem constituting the depending member extending through the slot in the respective tie member.

5. A canopy assembly as claimed in claim 1 in which the support members of adjacent side assemblies at ends remote from the central crown joint structures are connected together by flexible tie means.

6. A canopy assembly as claimed in claim 5 in which ends of the flexible tie means are clamped to respective support members.

7. A canopy assembly as claimed in claim 1 in which the tensioning means is a tensile cable.

8. A canopy assembly as claimed in claim 7 in which opposed ends of each tensile cable are connected to plates connected to the central crown joint structure ends of bracing members constituting the bracing means of the side assemblies.

9. A canopy assembly as claimed in claim 8 in which the plate of each bracing member is formed with a lug adapted to extend through a slot defined by the respective crown joint structure and to be retained releasably in connection therewith by a pin.

10. A canopy assembly as claimed in claim 1 in which the central mast structure comprises an outer sleeve, a tubular mast located within the outer sleeve and movable axially within the outer sleeve, cooperating formations respectively on the outer sleeve and the tubular mast to permit their relative disposition in a releasable axially-extended position, and adjustment means operatively connected to the tubular mast to permit the latter, while in the aforesaid releasable axially-extended position to be moved axially to increase or decrease the tension of the covering roof sheet when the latter is mounted and supported on the peripheral frame.

11. A canopy assembly as claimed in claim 10 in which the cooperating formations are constituted by opposed bayonet slots defined by the outer sleeve and a cooperating pin mounted on a projecting lower end of a spindle housed within the tubular mast.

12. A canopy assembly as claimed in claim 11 in which the adjustment means is a rotatable screw forming part of the spindle and screw-engaging the tubular mast to effect axial movement thereof relative to the outer sleeve.

13. A canopy assembly as claimed in claim 10 in which angularly-spaced securing plates extend radially outwards from the outer sleeve and have pivotally connected thereto the other ends of the bracing members.

14. A canopy assembly as claimed in claim 10 comprising flexible members connected respectively to and extending between the tubular mast and the central crown joint structures for supporting the covering roof sheet.

15. A canopy assembly as claimed in claim 14 in which the flexible members are webbing straps connected at one end, to the central crown joint structures by buckles and, at the other end, to a bolted clamping structure mounted on top of the tubular mast.

16. A tent structure comprising a canopy assembly as claimed in claim 1 mounted on vertical corner support pillars, each support pillar having at its upper ends two angularly-displaced connecting plates to each of which is connected an end of a support member of a side assembly of the peripheral frame.

17. A tent structure as claimed in claim 16 comprising for each connecting support member a pair of parallel connecting plates on the corner pillar, a connecting member of the support member being received between a secured to the connecting plates.

18. A tent structure as claimed in claim 16 including a positioning member at the top of each corner pillar, the positioning member being recessed to receive and locate the ends of adjacent support members of adjacent side assemblies connected to the corner pillar.

19. A tent structure as claimed in claim 16 in which each corner pillar is of hollow construction and is closed at its top by a tray for collecting water which defines a drainage hole to permit water to pass into the hollow pillar.

20. A tent structure as claimed in claim 19 in which each pillar is closed by an internal blanking-off plate adjacent to its bottom end to define a water collection chamber between the top tray and the blanking-off plate.

21. A tent structure as claimed in claim 20 comprising a water outlet on an external face of the hollow pillar, the water outlet communicating with the bottom of the water collection chamber.

22. A tent structure as claimed in claim 16 in which a ground-engaging foot is detachably connected to each corner pillar.

23. A tent structure as claimed in claim 22 in which the connection between each corner pillar and its ground-engaging foot is axially adjustable to permit height variation of the corner pillar.

24. A tent structure as claimed in claim 16 in which each pillar has open vertical housings or formations for receiving and locating retention elements secured to opposed ends of side walls for the tent structure.

25. A tent structure as claimed in claim 24 comprising a side wall between adjacent corner pillars, the retention elements of the side wall being slidably engaged in respective open vertical housings or formations of the corner pillars.

26. A tent structure as claimed in claim 25 in which a fastener is secured to the bottom of each side wall for securement to the ground or a floor.

27. A tent structure as claimed in claim 25 comprising tethering means secured to the bottom of the side wall adjacent an end thereof for securing the side wall to the corner pillar or corner pillar foot.

28. A tent structure as claimed in claim 16 in which each corner pillar mounts an external securing bracket for use in securing two or more corner pillars together or for securing an end of a storm cable arrangement.

29. A tent structure as claimed in claim 28 in which the storm cable arrangement comprises cables connected between the securing brackets on a corner pillar and the central crown joint structures of respective side assemblies of the peripheral frame.

30. A tent structure as claimed in claim 16 comprising a covering roof sheet secured to the side assemblies of the peripheral frame of the canopy assembly.

31. A modular arrangement of tent structures comprising at least two tent structures as claimed in claim 16 disposed in justapositioned relationship with corner pillars of the respective tent structures located in abutting relationship and fastening means being provided releasably to secure the abutting corner pillars together.

32. A modular arrangement of tent structures as claimed in claim 31 comprising securing brackets on abutting corner pillars and means for releasably locking the securing brackets on the abutting corner pillars together.

33. A pillar for supporting a canopy assembly of a tent structure above ground level, the pillar being of hollow construction and comprising a closure tray at the top of the pillar and defining a water drainage hole, an internal blanking-off plate provided adjacent the bottom of the pillar to define with the top tray a water collection chamber within the pillar, and a water outlet external of the pillar adjacent the internal blanking-off plate and in communication with the water collection chamber for water egress purposes.

34. A pillar as claimed in claim 33 comprising at its top end connecting plate means extending laterally of the pillar for attachment thereto of a structural member of a canopy assembly.

35. A pillar as claimed in claim 34 in which a ground-engaging foot is detachably connected to the pillar.

36. A pillar as claimed in claim 35 in which the connection between the pillar and its ground-engaging foot is axially adjustable to permit height variation of the pillar.

37. A pillar as claimed in claim 33 having opening vertical housings or formations for receiving and retaining end retention members of a wall of a tent structure.

* * * * *